US007097156B2

(12) United States Patent
Nam

(10) Patent No.: US 7,097,156 B2
(45) Date of Patent: Aug. 29, 2006

(54) SAFETY DEVICE OF AIR BALANCING HOIST

(75) Inventor: Sang Kyung Nam, Kyungki-do (KR)

(73) Assignee: Korea Hoist Co., Ltd., Siheung Kyungki-Do (KR)

( * ) Notice: Subject to any disclaimer, the term of this patent is extended or adjusted under 35 U.S.C. 154(b) by 0 days.

(21) Appl. No.: 11/005,960

(22) Filed: Dec. 7, 2004

(65) Prior Publication Data

US 2005/0211965 A1 Sep. 29, 2005

(30) Foreign Application Priority Data

Mar. 25, 2004 (KR) ..... 20-2004-0008331
Sep. 14, 2004 (KR) ..... 10-2004-0073591

(51) Int. Cl.
*B66D 1/00* (2006.01)

(52) U.S. Cl. ..... 254/331

(58) Field of Classification Search ..... 254/330, 254/331, 360
See application file for complete search history.

(56) References Cited

U.S. PATENT DOCUMENTS 3,933,388 A * 1/1976 Conboy ..... 294/64.1
4,520,998 A * 6/1985 Flaig ..... 254/267
5,522,581 A * 6/1996 Kulhavy ..... 254/267
5,553,832 A * 9/1996 Zaguroli, Jr. ..... 254/267
5,725,199 A * 3/1998 Yamamoto ..... 254/360
5,848,781 A * 12/1998 Kulhavy et al. ..... 254/360
6,547,220 B1 * 4/2003 Johnson ..... 254/331
6,695,292 B1 * 2/2004 Nam ..... 254/267
2003/0047726 A1 * 3/2003 Nam ..... 254/267

* cited by examiner

*Primary Examiner*—Emmanuel M Marcelo
(74) *Attorney, Agent, or Firm*—Ladas and Parry LLP

(57) ABSTRACT

A safety device of an air balancing hoist according to the present invention is provided to instantaneously brake a reel drum in the manner that a braking pawl mounted to be rotatable on an end cap is pushed to the outside direction of the circumference of a circle by centrifugal force to be locked into a ratchet wheel fixed on the end cap when the reel drum is suddenly fast rotated during a hoisting process. The safety device of the air balancing hoist comprises a housing including a chamber in which compressed air is induced/discharged; a piston connected into the inside of the housing to be slidably reciprocated; a ball screw penetrating the piston and including both ends fixed not to be rotated in the housing; a reel drum rotated along the ball screw upon movement; a ratchet wheel in a ring shape mounted on an inner side surface of an end cap formed at one end of the housing; a braking rotor mounted in the center of the end cap to be rotatable; a braking shaft, wherein one end is fixed on the rotor and the other end is connected with a fixing hole of the reel drum; and a braking pawl, wherein one end is elastically inserted in the braking rotor to be pivotable in the circumferential direction and the other end is fixed by a hinge on the braking rotor.

4 Claims, 8 Drawing Sheets

SAFETY DEVICE OF AIR BALANCING HOIST

CROSS-REFERENCE TO RELATED APPLICATIONS

This application claims benefit under 35 U.S.C. § 119 from Korean Patent Application No. 2004-73591 filed on Sep. 14, 2004 and Korean Utility Model Application No. 2004-8331 filed on Mar. 25, 2004, the entire content of which is incorporated herein by reference.

BACKGROUND OF THE INVENTION

1. Field of the Invention

The present invention relates to a safety device of an air balancing hoist for instantaneously stopping a hook from being suddenly lifted up by a sudden rotation of a reel drum in case where a workpiece is broken away from the hook or a switch is suddenly operated at more than a predetermined pressure in the hoisting process, as lifting up by means of the air balancing hoist driven by compressed air.

More specifically, the present invention relates to a safety device of an air balancing hoist for instantaneously braking the reel drum when a braking pawl, mounted to be rotated with not easy on an end cap, is pushed in the outward direction of the circumference of a circle by centrifugal force and is locked into a ratchet wheel in case the reel drum is suddenly rotated during the hoisting process.

2. Description of the Related Art

In general, when a light or heavy weight workpiece lifted by a hook is assembled or mounted at a predetermined position as in a vehicle production line, an air balancer is mostly used to lift up the hook by a cylinder drive which is reciprocated within a predetermined stroke by an air pressure supplied as a worker operates a switch.

FIGS. 1 and 2 schematically show a conventional air balancing hoist. As shown in FIGS. 1 and 2, the air balancing hoist includes a cylindrical housing 2 with a chamber 1 through which compressed air is induced in or discharged from an air supply source when a push button switch P is selected by a user; a ball screw 5 with both ends fixed by locking members 3 and 4 not to be rotated around the inside of the housing 2; an end cap 7, mounted at one end of the housing 2, for tightly closing a chamber 1, including a manifold 6 mounted at one outer side to induce or discharge the compressed air; a piston 8 slidably reciprocated along an inner periphery of the housing 2 by the air pressure induced into the chamber 1; and a reel drum 12, whose an end fixed by a ball nut 9 engaged with the ball screw 5 and the other end supported to be rotatable at the piston 8 by a bearing 10, for rotating by driving power at the piston 8 from side to side and winding up an wire 11.

When an up lever P1 of the push button switch P is operated by a user, the compressed air from the air supply source passes through the manifold 6 so as to be supplied to the chamber 1, such that the piston 8 is slidably moved to the left direction along the inner periphery of the housing 2 as shown in FIG. 1.

As the reel drum 12 supported by the piston 8 through the bearing 10 is axially moved by the rectilinear movement of the piston 8, and simultaneously the reel drum 12 supported by the ball screw 5 through the ball nut 9 is rotated, an outer periphery of the reel drum 12 is wound with the wire 11. Thereby, it is possible to lift up the workpiece fixed by the hook assembly which is also fixed at the end of the wire 11.

On the other hand, when a down lever P2 of the push button switch P is operated, as the compressed air in the chamber 1 is discharged in the air though the manifold 6, the reel drum 12 is rotated along the ball screw 5 and is moved to the right direction in FIG. 1 so that the wire 11 is unwound from the reel drum 12. Thereby, it is possible to descend the workpeice fixed to the hook assembly.

However, when the workpeice is broken away from the hook during the hoisting process using the aforementioned air balancing hoist, the compressed air in the chamber 1 is suddenly expanded so that the reel drum 12 is very speedily rotated and therefore the hook assembly is suddenly lifted up. Thereby, it may cause an accident that a hook or a jig fixed on the hook may strike the worker.

Taking consideration such a problem, a braking pipe 21, where a ratchet groove 20 is, in the circumferential direction, formed on the outer periphery, is integrally fixed to the end cap 22; a ring-shaped groove 25 corresponding to the braking pipe 21 is formed longitudinally; and a braking pawl 24 is mounted to be pivotable in the circumferential direction on the side surface of the reel drum 12. Thereby, when the reel drum 12 is suddenly rotated, the braking pawl 24 is pivoted in the circumferential direction to be locked into the ratchet groove 20 to instantaneously brake the reel drum 12.

However, the air balancing hoist described above has the problems that since the braking pipe 21 is made of metal material and weighs heavy, the work competitiveness for assembling the completed products is decreased by the overweight of the whole hoist, and that since the ring-shaped groove 25 corresponding to the braking pipe 21 is formed on the reel drum 12, the mechanical strength of the reel drum 12 is weakened.

On the other, if the up lever P1 of the push button switch P is pressed at more than the predetermined pressure during the hoisting process, the compressed air in great volume is instantaneously induced into the chamber 1 and thereby suddenly rotating the reel drum 12. Hence, the hook is suddenly raised (raised by about 1 M per second) and the workpiece pulled by the hook may stroke the worker to cause the accident.

Taking consideration this problem, a safety device (not shown) is installed on a hose for inducing the compressed air at the push button switch P. When the up lever P1 is suddenly operated at more than the predetermined pressure, a spool of the safety device is alternated to discharge the compressed air induced into the chamber 1 in the air to be intercepted, and thereby preventing the hook from being suddenly raised by the sudden rotation of the reel drum 12.

However, in case of additionally mounting the safety device described above to the push button switch P, there are still the problems that the whole cost for products is high by increasing the number of components, and that the competitiveness of the products may be decreased accordingly.

SUMMARY OF THE INVENTION

An object of the invention is to solve at least the above problems and/or disadvantages and to provide at least the advantages described hereinafter.

Accordingly, one object of the present invention is to provide a safety device of an air balancing hoist, where upon suddenly fast rotation of a reel drum during a hoisting process, a braking pawl mounted on an end cap is locked into a ratchet wheel fixed on the end cap by centrifugal force to instantaneously fast brake the reel drum, thereby enhancing the braking force and the reliability on the product by preventing the reel drum from being pushed and broken away.

Another object of the present invention is to provide a safety device of an air balancing hoist for preventing a hook from being suddenly raised by optionally operating an up lever stroke of a push button switch, thereby protecting a worker from an accident, requiring no additional safety device, and reducing the cost of production by decreasing the number of corresponding components.

Further another object of the present invention is to provide a safety device of an air balancing hoist to fast brake, at any position, a reel drum which is suddenly fast rotated during the hoisting process, thereby securing the safety and protecting a worker.

Still another object of the present invention is to provide a safety device of an air balancing hoist, where it is not necessary to disassemble and reassemble a braking device from the hoist in order to return the braking device to an original state after fast braking a reel drum, and to prevent interior components of a housing from being damaged when braking the reel drum so that the components are usable semi-permanently.

The above-described objects are achieved by providing a safety device of an air balancing hoist comprises: a housing including a chamber for inducing/discharging compressed air by operation of a switch; a first end cap, mounted at one end of the housing, for tightly closing the chamber, the first end cap where a manifold for inducing/discharging the compressed air from the chamber is formed on an outer side surface; a piston combined with the inside of the housing to be slidably reciprocated; a ball screw penetrated the piston where both ends are fixed not to be rotated in the housing; a reel drum whose one side is fixed to be rotatable by a bearing fixed on the piston and the other side is fixed on a ball nut combined with the ball screw, the reel drum rotated along the ball screw in case of movement; a ratchet wheel in a ring shape, mounted on an inner side of a second end cap formed on the other end of the housing; a braking rotor mounted on the inside of the ratchet wheel to be rotatable around the second end cap; a braking shaft whose one end is connected with a fixing hole formed on the reel drum and the other end is fixed on the braking rotor; a braking pawl whose one end is elastically inserted in the braking rotor to be pivotable in the circumferential direction and the other end is fixed on the braking rotor by a hinge.

According to a preferred embodiment, the ratchet wheel in the ring shape is mounted and made of at least one or more circular plates.

The push button switch includes up/down levers for controlling a supply and a discharge of the compressed air in the chamber; a body mounted in a passage where an entrance and an exit of the compressed air are connected, where a cylinder is provided inside for selectively opening and closing the entrance and the exit through which the compressed air passes as the spool is slidably moved when the up/down levers are operated; and a stroke control member to prevent the up lever from being suddenly operated at more than a predetermined pressure, the member mounted on the body for controlling the stroke of the up lever.

Further, The push button switch includes a penetrating hole which is formed to penetrate the up lever, opposite to the end of the stroke control member, and which adjusts the stroke of the up lever by increase or decrease in accordance with the direction that the stroke control member is rotated.

Further, the push button switch includes a slope on the outer periphery of the spool for controlling an amount of the compressed air induced in the chamber, in response to the extent of pressurizing the up lever.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

The following detailed description will present a safety device of an air balancing hoist according to a preferred embodiment of the invention in reference to the accompanying drawings.

Figure 1:
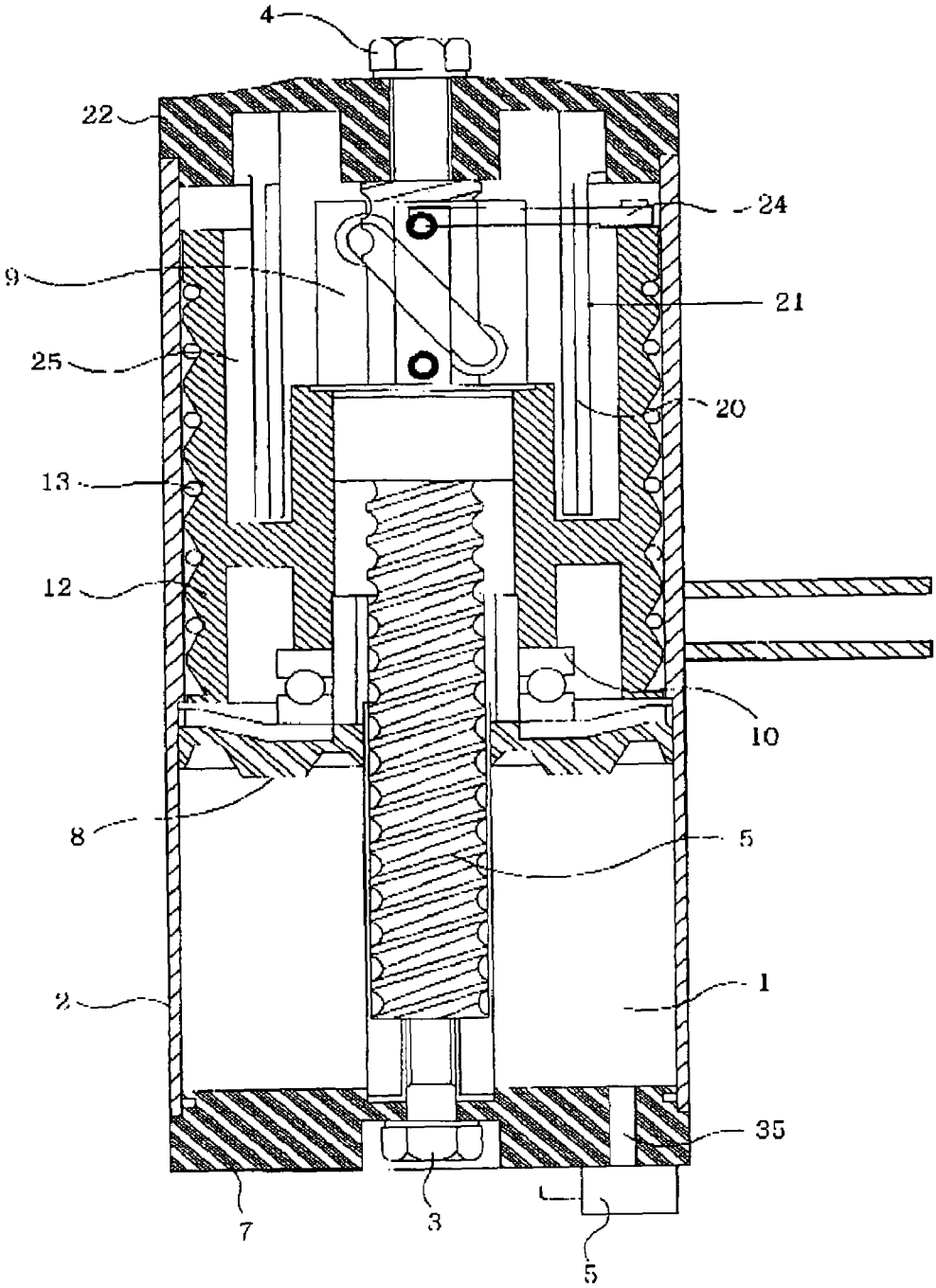
Fig. 1 Prior Art
FIG. 1 is a schematic view of a conventional air balancing hoist in which a safety device is mounted.
Figure 2:
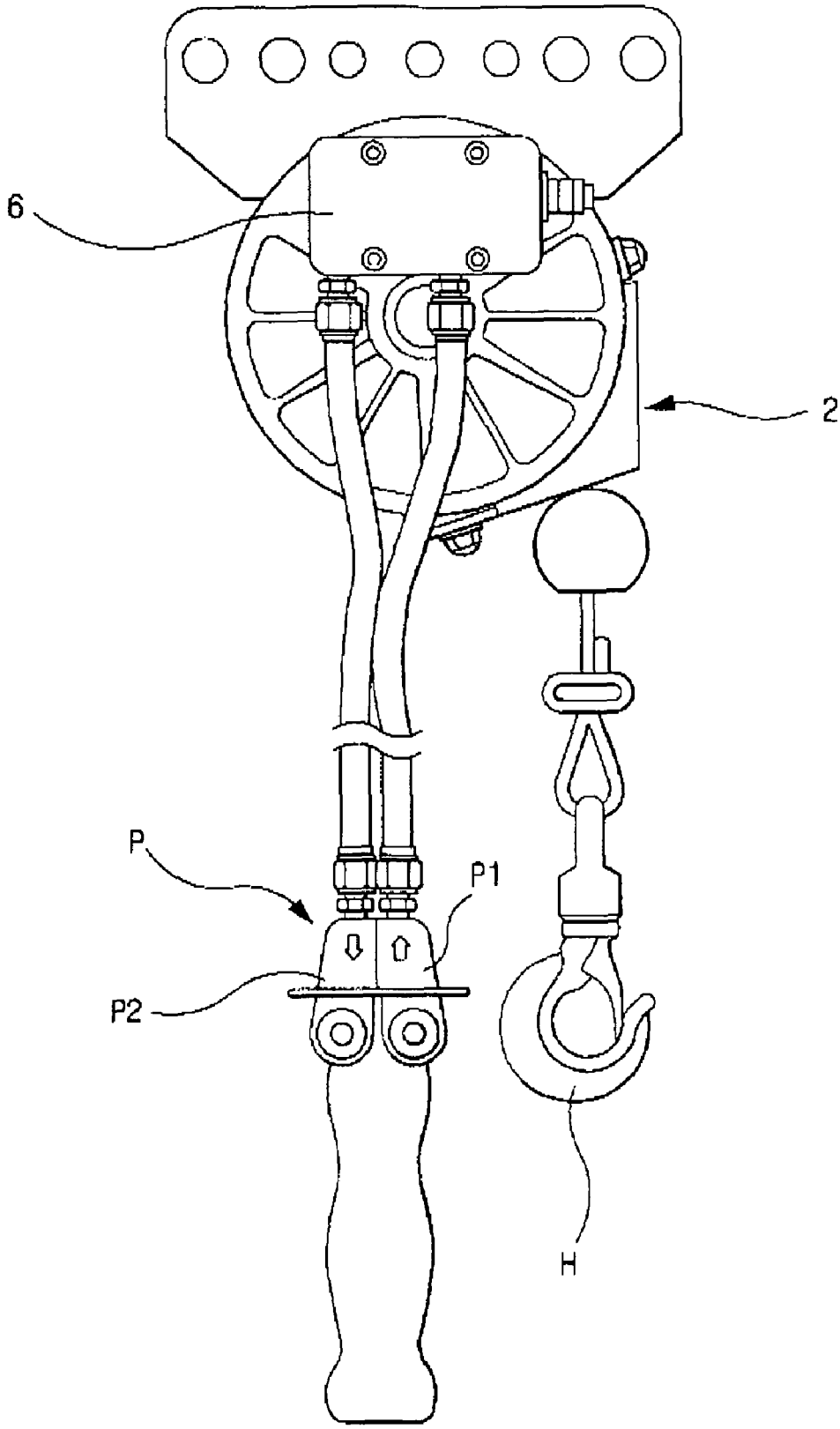
Fig. 2 Prior Art
FIG. 2 is a schematic view of a push button switch for driving the air balancing hoist of FIG. 1.
Figure 3:
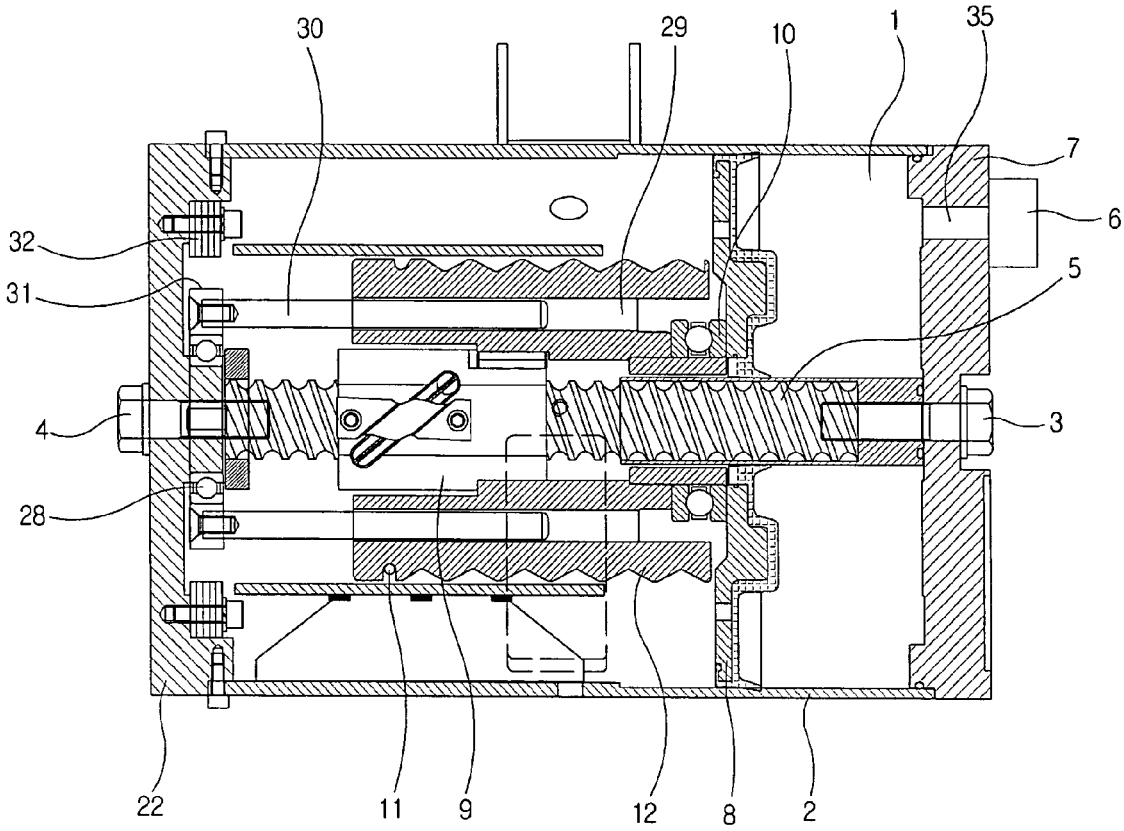
FIG. 3 is a sectional view of a safety device of an air balancing hoist according to the present invention.
Figure 4:
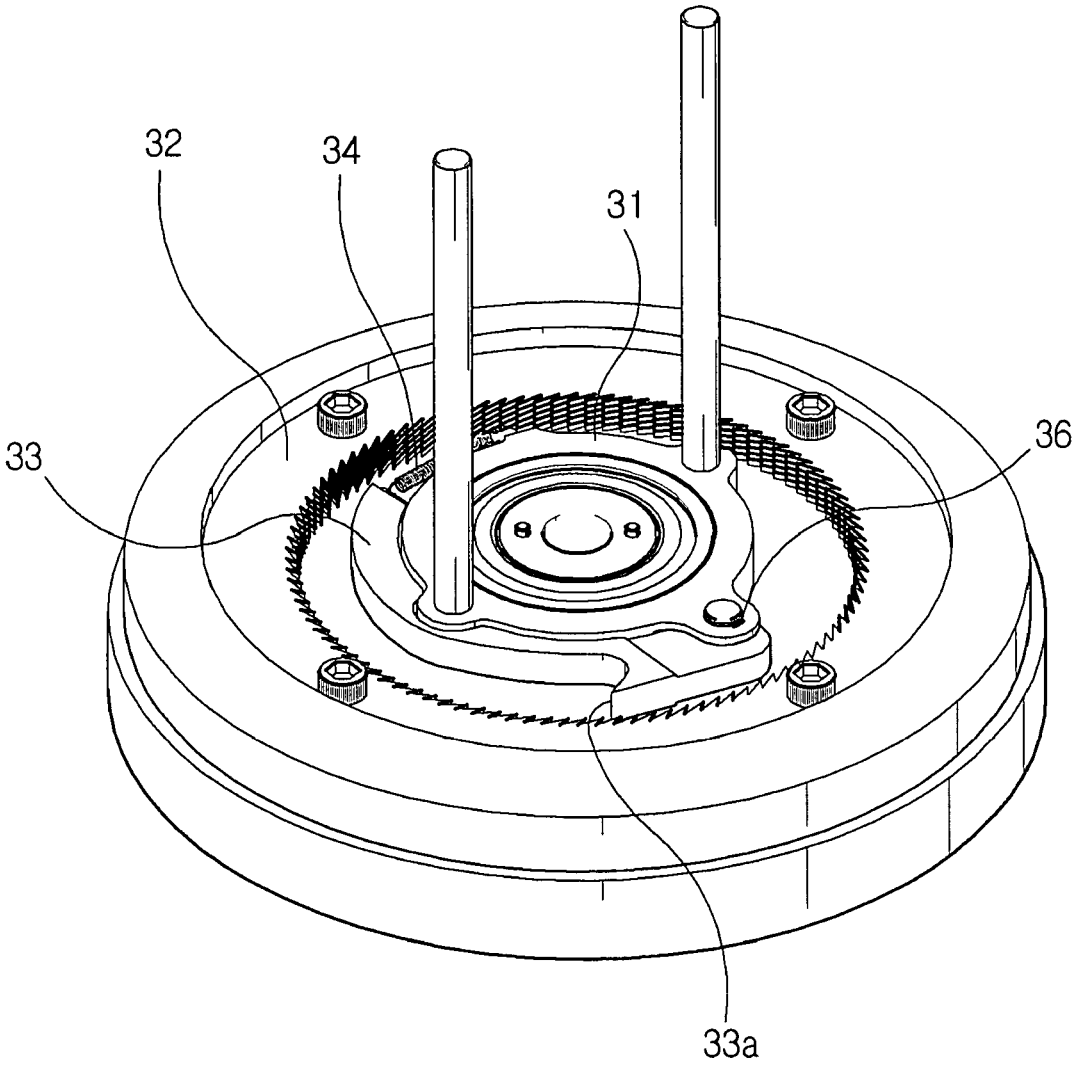
FIG. 4 is a perspective view of an essential part of the safety device of an air balancing hoist according to the present invention.
Figure 5:
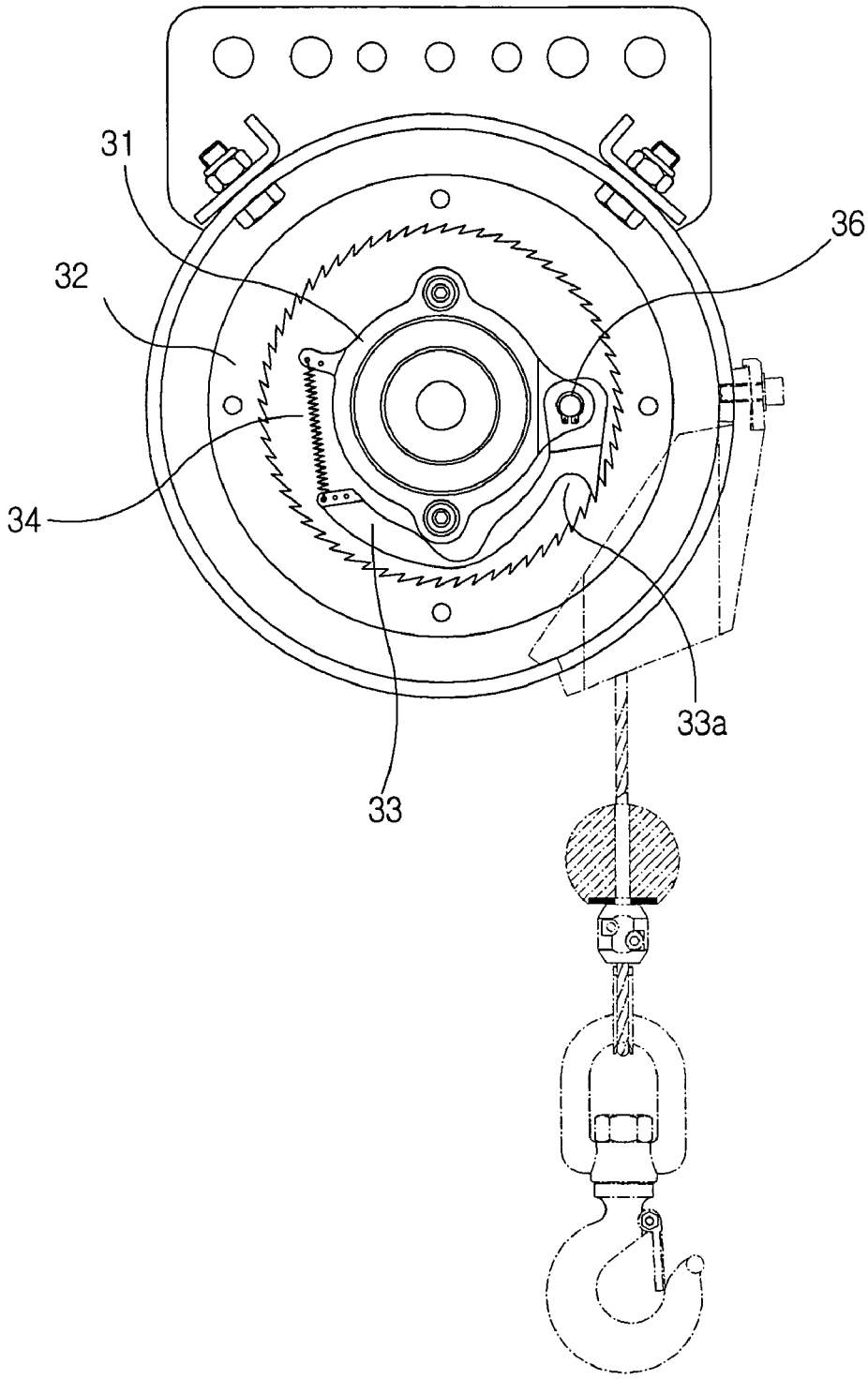
FIG. 5 is a view of an use state of the safety device of an air balancing hoist according to the present invention.

As shown in FIGS. 3 to 5, a safety device of an air balancing hoist according to the present invention includes a housing 2 in a cylindrical shape including a chamber 1 where compressed air is induced/discharged by an operation of a push button switch P by a user; a first end cap 7, mounted at one end of the housing 2 to tightly close the chamber, including a manifold 6 for inducing/discharging the compressed air in the chamber 1; and a piston 8 combined to be slidably reciprocated in the housing 2.

The safety device of the air balancing hoist further includes a ball screw 5 in which both ends are fixed by locking members 3 and 4 to be penetrated the piston 8 and not to be rotated around the inner center of the housing 2; and a reel drum 12, where whose one side is fixed to be rotatable around the piston 8 by a bearing 10 and the other is fixed on a ball nut 9 combined with the ball screw 5, for winding wire 11 by rotating when moving along the ball screw 5 by the driving power of the piston 8.

The safety device of the air balancing hoist further includes a ratchet wheel 32 formed of at least one or more circular plates, mounted in the inner side surface of a second end cap 22 formed at the other end of the housing 2; a braking rotor 31 mounted to be rotatable inwardly to the ratchet wheel 32 on the second end cap 22 by a bearing 28;

and a pair of braking shafts 30, where whose one end is combined with a fixing hole 29 longitudinally formed at the reel drum 12 and the other end is fixed on the braking rotor 31, the braking shafts integrally rotated when the reel drum 12 is rotated.

The safety device of the air balancing hoist further includes a braking pawl 33, where whose one end is elastically supported by an elastic member 34 to be pivotable in the circumferential direction to the braking rotor 31 and the other end is fixed by a hinge to the braking rotor 31 by a fixing pin 36, the braking pawl 33 pivoted to be locked into the ratchet wheel 32 by centrifugal force to fast brake the reel drum 12 when the reel drum 12 is suddenly fast rotated.

The push button switch P includes an up lever P1 and a down lever P2 for controlling the induction and discharge of the compressed air in the chamber 1; a body 45, mounted on an passage 42 where an entrance 40 and an exit 41 of the compressed air are connected with each other, where a cylinder 44 is provided inside for selectively opening and closing the entrance 40 and the exit 41 through which the compressed air passes as a spool 43 is slidably moved when the up lever P1 and the down lever P2 are operated; and a stroke control member 46 for preventing the up lever P1 from being suddenly operated at more than a predetermined pressure, the member 46 mounted on a screw hole 45*a* formed in the body 45 for controlling the stroke of the up lever P1.

Further, the push button switch P includes a penetrating hole 47 which is formed to penetrate the up lever P1, opposite to the end of the stroke control member 46, and which adjusts the stroke of the up lever by increase or decrease in accordance with the direction that the member 46 for controlling the stroke is rotated; and a slope 43*a* on the outer periphery of the spool 43 for controlling an amount of the compressed air induced in the chamber 1, in response to the extent of pressurizing the up lever P1.

In the drawings, a reference numeral 35 not described is a penetrating hole for supplying the compressed air into the chamber 1 through the manifold 6, and a reference numeral 48 is a safety spring for protecting the push button switch P from the outside.

Figure 6:
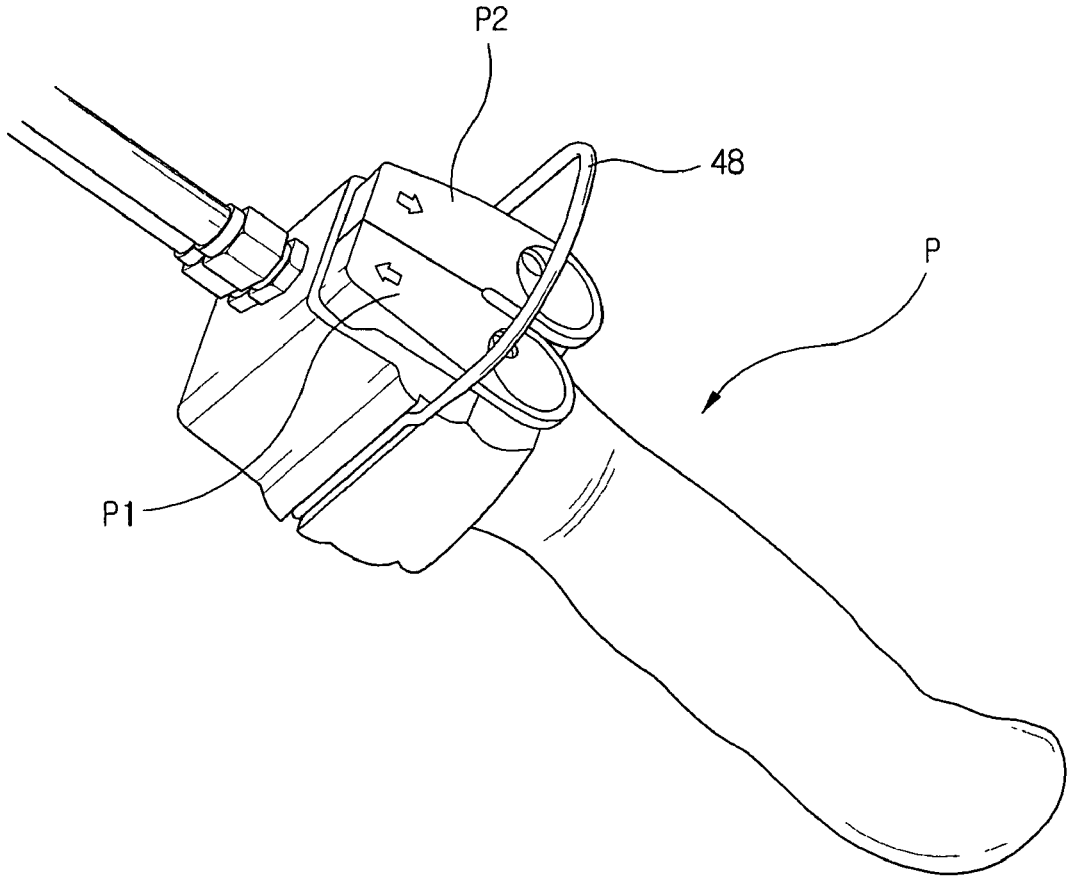
FIG. 6 is a schematic view of a push button switch for driving the air balancing hoist of FIG. 3.
Figure 7:
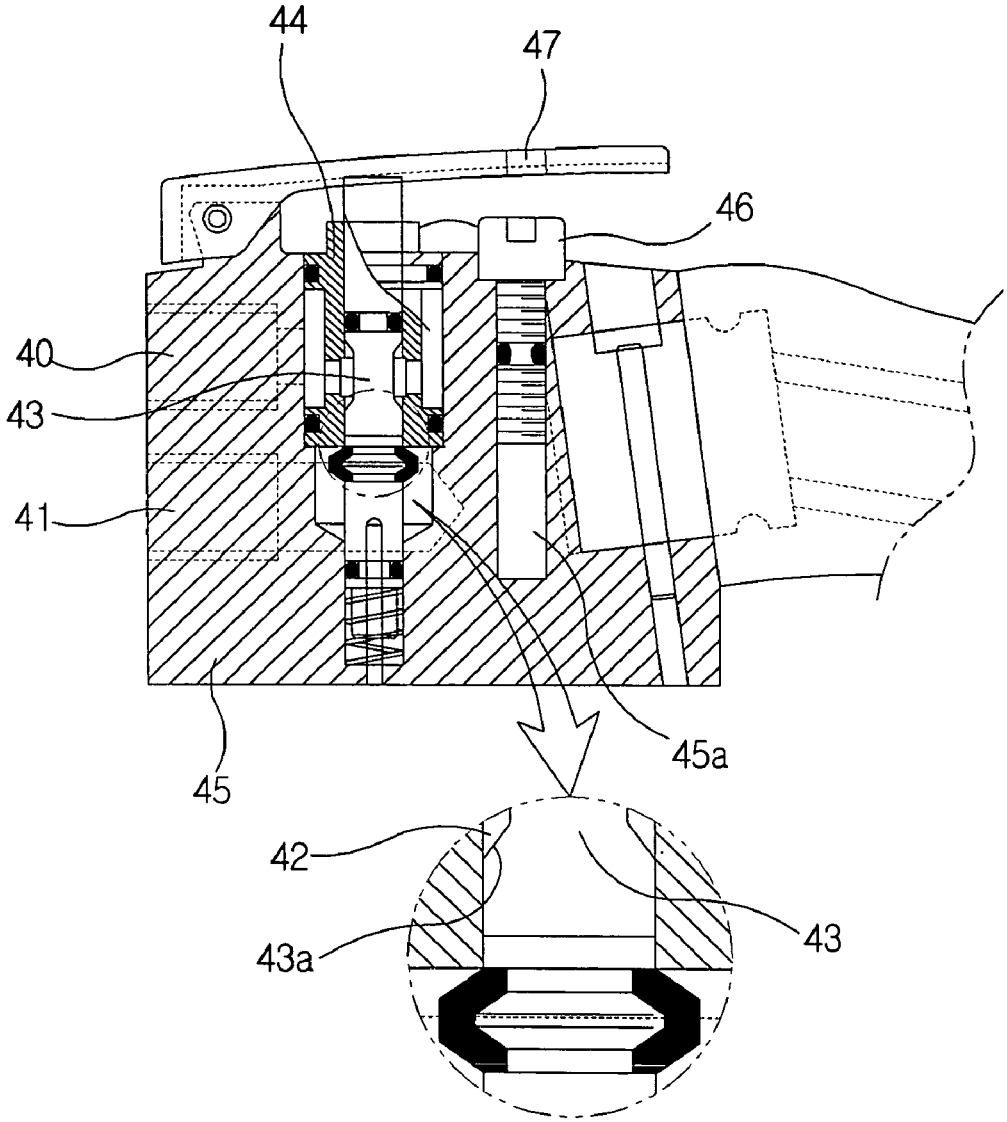
FIG. 7 is an enlarged view of an essential part of the push button switch of FIG. 6.

The operation for using the safety device of the air balancing hoist according to the present invention is explained with reference to below:

As shown in FIGS. 6 and 7, when the user operates the up lever P1 of the push button switch P; the spool 43 of the cylinder 44, installed to be slidably moved in lower and upper direction in the passage 42 of the body 45, is moved downwardly in the drawing.

Thereby, the compressed air discharged from the compressed air supply source (not shown) is passed through the entrance 40 of the compressed air in the body 45, the passage 42 opened by the spool 43 and the exit 41 of the compressed air, then, an air hose (not shown) connected with the exit 41, and thereby supplying the compressed air in the manifold 6 attached to the outer side surface of the housing 2.

As shown in FIG. 3, as the compressed air supplied into the manifold 6 is supplied into the chamber 1 of the housing through the penetrating hole 35 formed in the first end cap 7, the piston 8 is slidably moved along the inner periphery of the housing 2.

When the piston 8 is moved, the reel drum 12, which is fixed to be rotatable to the piston 8 by the bearing 10 and is fixed to be movable along the ball screw 6 by the ball nut 9, is reversely rotated around the ball screw 5 and moved to the left direction and therefore the wire 11 is wound to the outer periphery of the reel drum 12 as in FIG. 3.

If the spool 43 is descended in accordance with the pressurization of the up lever P1, a discharging hole of the passage 42 is controlled by the slope 43*a* formed on the outer peripheral of the spool 43 and therefore the amount of the compressed air flowed into the chamber 1 is controllable. Thereby, the amount of the air as flowed into the chamber 1 is controlled according to the extent of pressurization of the up lever P1 so that it is possible to control the rate that the hook is raised.

Figure 8:
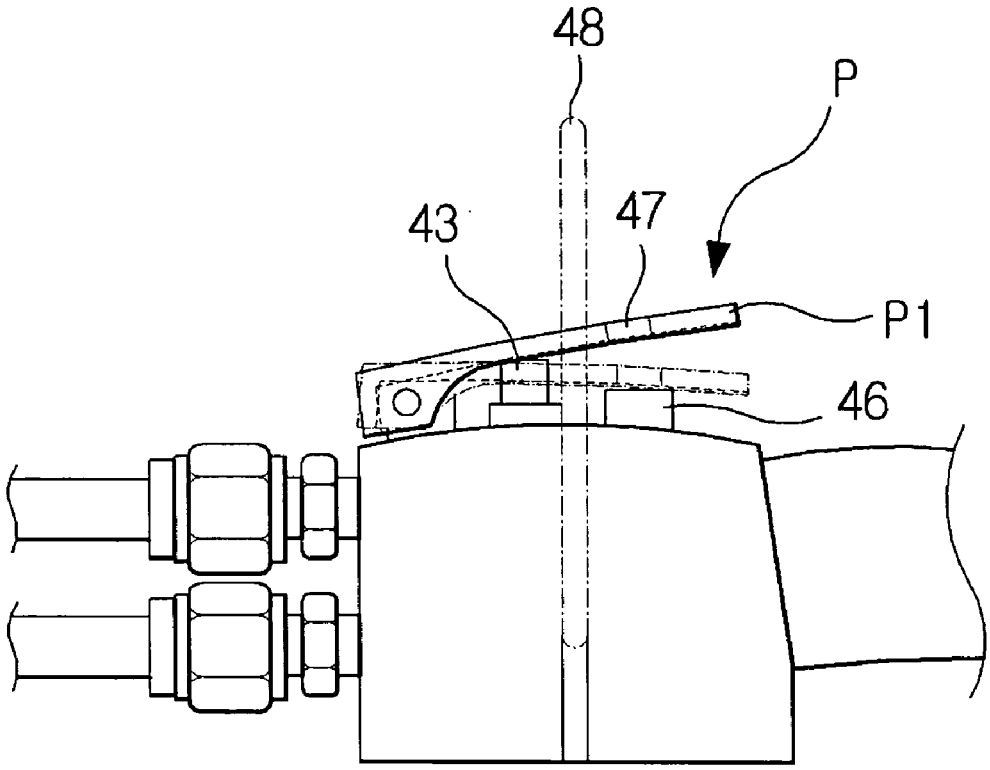
FIG. 8 is a view of a use state of the push button switch of FIG. 6.

As shown in FIG. 8, it is possible to prevent the hook from being suddenly raised as caused by suddenly operating the up lever P1 at more than the predetermined pressure during the hoisting process. As a tool such as a driver is inserted into the penetrating hole 47 formed to penetrate the up lever P1 to control the height of the stroke control member 46 connected with the screw hole 45*a* of the body 45, thereby optionally controlling the stroke of the up lever P1.

Therefore, even if the up lever P1 is pressurized at more than the predetermined pressure by a wrong operation of the user, it can be prevented the up lever P1 from being pressurized to the full state by the stroke control member 46, thereby preventing the reel drum 12 from being suddenly fast rotated when the compressed air in great volume is instantaneously induced into the chamber 1.

During the hoisting process, if the workpiece is broken away from the hook or hook assembly fixed on the wire 11 and therefore, the reel drum 12 is suddenly fast rotated by the sudden expansion of the compressed air supplied into the chamber 1 of the housing 2, it is possible to suddenly fast brake the reel drum 12 by locking the braking pawl 33, which is fixed to be pivotable in the circumferential direction about the breaking rotor 31 fixed to be rotatable with not easy in the center of the second end cap 22, into the ratchet wheel 32, which is formed in a number of circular plates and mounted in the inner side surface of the second end cap 22.

When the reel drum 12 is rotated, the breaking rotor 31 is rotated in the same direction that the reel drum 12 is rotated by a pair of the braking shafts 30 integrally rotated in combination with the fixing hole 29 formed on the reel drum 12.

As shown in FIG. 5, if the reel drum 12 is suddenly fast rotated, the braking pawl 33 fixed to be pivotable about the braking rotor 31 is pushed to the circumferential direction based on the fixing ping 36 as the central shaft (that is, the braking pawl 33 is pivoted counterclockwise; the elastic member 34 is at tension). Then, the claw 33*a* of the braking pawl 33 is pivoted counterclockwise to be instantaneously locked into be attachable to or detachable from the ring shaped ratchet wheel 32 fixed on the second end cap 22, thereby suddenly fast braking the reel drum 12 which is fast rotated.

In case of removing the brake of the braking pawl 33 and the ratchet wheel 32 suddenly fast braking the reel drum 12, if the down lever P2 of the push button switch P is operated, the compressed air supplied in the chamber 1 of the housing 2 is discharged in the air through the manifold 6.

Thereby, the braking pawl 33 is pivoted in a clockwise direction based on the fixing pin 36 as the central shaft, by the restitution of the elastic member 34 supporting the braking pawl 33 fixed to be pivotable to the braking rotor 31, and therefore the claw 33*a* of the braking pawl 33 is separated from the ratchet wheel 32 so that the brake state of the reel drum 12 is removed.

Accordingly, after braking the suddenly fast rotation of the reel drum 12 during the hoisting process, it is not necessary to reassemble the air hoist by removing the brake after separating the braking device from the air hoist in order to remove the locking of the braking device as in conventional reel drum braking device of the air hoist.

As described above, the safety device of the air balancing hoist according to the present invention has the merits below.

The reel drum is instantaneously fast braked by locking the breaking pawl mounted on the end cap into the ratchet wheel fixed on the end cap by the centrifugal force during the hoisting process, thereby providing the excellent braking force and the reliability of a product by preventing the reel drum from being pushed when locking the suddenly fast brake.

Further, the stroke of the up lever of the push button switch is optionally controlled to prevent the hook from being suddenly raised, thereby protecting a worker from an accident; and any additional safety device does not need to be mounted on the push button switch, thereby reducing the number of corresponding components to cut the costs of production.

Further, it is possible to suddenly fast brake, at any position, the reel drum which is suddenly fast rotated during the hoisting process, thereby securing safety.

Further, it is not necessary to dissemble or reassemble the braking device from the hoist in order to return the braking device to the original position after suddenly fast braking the reel drum, and it is possible to prevent interior components from being damaged when braking the reel drum, thereby making it possible to be used semi-permanently.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A safety device of an air balancing hoist comprising:

a housing including a chamber in which compressed air is induced/discharged by an operation of a push button switch;

a first end cap, mounted at one end of the housing, for tightly closing the chamber, where a manifold for inducing and discharging the compressed air into the chamber is formed on an outer side surface;

a piston connected in the housing to be slidably reciprocated;

a ball screw penetrating the piston and having both ends fixed against rotation in the housing;

a reel drum having one end fixed to be rotatable by a bearing fixed on the piston and a second end fixed on a ball nut connected to the ball screw, for rotating along the ball screw;

a ratchet wheel of ring shape mounted on an inner side surface of a second end cap formed at the other end of the housing;

a braking rotor mounted inwardly in the ratchet wheel to be rotatable around the second end cap;

a braking shaft having one end connected to a fixing hole formed on the reel drum and a second end is fixed on the rotor; and a braking pawl having one end elastically inserted in the braking rotor to be pivotable in a circumferential direction and a second end fixed by a hinge on the braking rotor, wherein the push button switch comprises:

an up lever and a down lever for controlling a supply and a discharge of the compressed air in the chamber;

a body mounted on a passage connected with an entrance and an exit of the compressed air and provided with a cylinder for selectively opening and closing the entrance and the exit of the compressed air as a spool is slidably moved when operating the up lever and the down lever; and a stroke control member, mounted on the body to control the stroke of the up lever, for preventing the up lever from being suddenly fast operated at more than a predetermined pressure.

2. The safety device according to claim 1, wherein the ratchet wheel of ring shape is mounted by one or more circular plates.

3. The safety device according to claim 1, further comprising a penetrating hole which is formed to penetrate the up lever, opposite an end of the stroke control member, for controlling the stroke of the up lever, by an increase or decrease, in accordance with rotation direction of the stroke control member.

4. The safety device according to claim 1, further comprising a slope formed on an outer periphery of the spool for controlling an amount of the compressed air induced into the chamber, corresponding to the extent of pressurization of the up lever.

* * * * *